US010584668B2

(12) United States Patent
Usui et al.

(10) Patent No.: US 10,584,668 B2
(45) Date of Patent: Mar. 10, 2020

(54) HIGH-PRESSURE FUEL PUMP AND METHOD FOR PRODUCING SAME

(71) Applicant: Hitachi Automotive Systems, Ltd., Hitachinaka-shi, Ibaraki (JP)

(72) Inventors: Satoshi Usui, Hitachinaka (JP); Atsushi Hohkita, Hitachinaka (JP); Masayuki Suganami, Hitachinaka (JP); Kenichiro Tokuo, Hitachinaka (JP); Minoru Hashida, Hitachinaka (JP); Masamichi Yagai, Hitachinaka (JP); Yuta Saso, Hitachinaka (JP); Kazuaki Tokumaru, Hitachinaka (JP); Atsuji Saito, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 15/575,578

(22) PCT Filed: Jul. 25, 2016

(86) PCT No.: PCT/JP2016/071663
§ 371 (c)(1),
(2) Date: Nov. 20, 2017

(87) PCT Pub. No.: WO2017/038298
PCT Pub. Date: Mar. 9, 2017

(65) Prior Publication Data

US 2018/0135581 A1 May 17, 2018

(30) Foreign Application Priority Data

Aug. 28, 2015 (JP) ..... 2015-168451

(51) Int. Cl.
*F02M 59/46* (2006.01)
*F02M 59/02* (2006.01)
(Continued)

(52) U.S. Cl.
CPC ..... *F02M 59/466* (2013.01); *F02M 21/0245* (2013.01); *F02M 37/04* (2013.01);
(Continued)

(58) Field of Classification Search
CPC ... F02M 59/446; F02M 59/025; F02M 59/102
(Continued)

(56) References Cited

U.S. PATENT DOCUMENTS

2004/0105763 A1 6/2004 Kondo
2007/0110603 A1* 5/2007 Usui ..... F02M 63/005 417/505

(Continued)

FOREIGN PATENT DOCUMENTS

EP 1 479 903 A1 11/2004
EP 2 541 039 A1 1/2013

(Continued)

OTHER PUBLICATIONS

International Search Report (PCT/ISA/210) issued in PCT Application No. PCT/JP2016/071663 dated Oct. 4, 2016 with English translation (4 pages).

(Continued)

*Primary Examiner* — Mahmoud Gimie
(74) *Attorney, Agent, or Firm* — Crowell & Moring LLP

(57) ABSTRACT

Provide is a high-pressure fuel pump capable of improving the degree of freedom of layout of members to be attached to a pump body and a producing method thereof. Therefore, the high-pressure fuel pump includes the suction joint that sucks fuel, the pump body formed with the pressurizing chamber that pressurizes the fuel sucked from the suction joint, and the discharge joint that discharges the fuel pressurized in the pressurizing chamber. The pump body is formed so that at least a part of the side surface portion thereof becomes a cylindrical portion or a polygonal shape
(Continued)

portion. At least one of the discharge joint and the suction joint may be fixed on the inner peripheral side with respect to the outermost peripheral portion of the cylindrical portion or the polygonal shape portion of the side surface portion.

10 Claims, 9 Drawing Sheets

(51) Int. Cl.
*F02M 21/02* (2006.01)
*F02M 69/02* (2006.01)
*F02M 37/04* (2006.01)
*F02M 59/10* (2006.01)

(52) U.S. Cl.
CPC ..... *F02M 69/02* (2013.01); *F02M 59/025* (2013.01); *F02M 59/102* (2013.01); *F02M 2200/80* (2013.01)

(58) Field of Classification Search
USPC ..... 123/509, 508
See application file for complete search history.

(56) References Cited

U.S. PATENT DOCUMENTS

| | | | | |
|---|---|---|---|---|
| 2007/0286742 | A1* | 12/2007 | Inoue | F02M 59/02 417/269 |
| 2009/0110575 | A1 | 4/2009 | Munakata et al. | |
| 2010/0126474 | A1* | 5/2010 | Siegel | F02M 59/34 123/508 |
| 2012/0247591 | A1 | 10/2012 | Kuroyanagi et al. | |
| 2012/0312278 | A1 | 12/2012 | Usui et al. | |

FOREIGN PATENT DOCUMENTS

| | | | |
|---|---|---|---|
| JP | 11-6475 | A | 1/1999 |
| JP | 2004-183552 | A | 7/2004 |
| JP | 2006-299918 | A | 11/2006 |
| JP | 2009-501866 | A | 1/2009 |
| JP | 2009-108784 | A | 5/2009 |
| JP | 2011-74759 | A | 4/2011 |
| JP | 2011-179319 | A | 9/2011 |
| JP | 2012-215164 | A | 11/2012 |
| JP | 2015-98849 | A | 5/2015 |
| WO | WO 2015/072080 | A1 | 5/2015 |

OTHER PUBLICATIONS

Extended European Search Report issued in counterpart European Application No. 16841330.0 dated Nov. 12, 2018 (seven (7) pages).
Japanese-language Office Action issued in counterpart Japanese Application No. 2017-537649 dated Feb. 26, 2019 (six (6) pages).

* cited by examiner

HIGH-PRESSURE FUEL PUMP AND METHOD FOR PRODUCING SAME

TECHNICAL FIELD

The present invention relates to a high-pressure fuel pump and a method for producing the same.

BACKGROUND ART

A high-pressure fuel pump which is easy to assemble and has a short axial length is known (see, for example, PTL 1). This PTL 1 discloses "a housing body of a high-pressure fuel pump has a flange formed therein, and three attachment holes are provided on this flange at equal intervals circumferentially around the center axis of the plunger on the same circumference. Three spaces formed between the attachment holes adjacent in the circumferential direction are substantially equal, and a piping joint, a metering valve, and a discharge valve are installed one by one on the outer circumference side of the housing body between the circumferentially adjacent mounting holes. Each axis of the piping joint, the metering valve and the discharge valve is directed toward the center axis of the plunger and is orthogonal to the central axis" (See abstract).

CITATION LIST

Patent Literature

PTL 1: JP 2006-299918 A

SUMMARY OF INVENTION

Technical Problem

In FIG. 1 of PTL 1, a boss portion projecting toward the outer circumference side is formed in the housing body, and the piping joint, the metering valve and the discharge valve are attached to the boss portion. When the boss portion is provided in the housing body in this way, a position where the piping joint, the metering valve, and the discharge valve are attached is fixed at a position of the boss portion.

As a member to be attached to a pump body of the high-pressure fuel pump, a suction joint, a discharge joint, an electromagnetic suction valve mechanism and the like are conceivable. When the high-pressure fuel pump is attached to an engine, it is necessary to redesign the arrangement of the suction joint, the discharge joint, the electromagnetic suction valve mechanism, and the like from the relationship of an engine side layout. However, according to the conventional structure, there is a problem that it is impossible to change the positions of the suction joint, the discharge joint, the electromagnetic suction valve mechanism and the like, and the layout property of these parts is poor.

In this case, in order to change the arrangement of the suction joint, the discharge joint, the electromagnetic suction valve mechanism and the like from the relation of the engine side layout, in each case, it is necessary to change the shape of the pump body, that is, to change the position of the boss portion. This leads to an increase in the number of models of pump bodies and an increase in producing costs such as management costs.

An object of the present invention is to provide a high-pressure fuel pump capable of improving the degree of freedom of layout of members to be attached to a pump body and a producing method thereof.

Solution to Problem

In order to achieve the above object, the present invention provides a high-pressure fuel pump including: a suction joint that sucks fuel; a pump body formed with a pressurizing chamber that pressurizes the fuel sucked from the suction joint; and a discharge joint that discharges the fuel pressurized in the pressurizing chamber, wherein the pump body is formed such that at least a part of a side surface portion is a cylindrical portion or a polygonal shape portion, and at least one of the discharge joint and the suction joint is fixed on an inner peripheral side with respect to an outermost peripheral portion of the cylindrical portion or the polygonal shape portion of the side surface portion.

Advantageous Effects of Invention

According to the present invention, it is possible to improve the degree of freedom in the layout of a member to be attached to a pump body. The problems, configurations, and effects other than those described above will be clarified from the description of the embodiments below.

DESCRIPTION OF EMBODIMENTS

Hereinafter, with reference to the drawings, the configuration and operational effects of a high-pressure fuel pump (high-pressure fuel supply pump) according to first and second embodiments of the present invention will be described.

(Overall Structure)

First, with reference to FIG. 5, the configuration and operation of an engine system including the high-pressure fuel pump according to the first and second embodiments of the present invention will be described.

Figure 5:
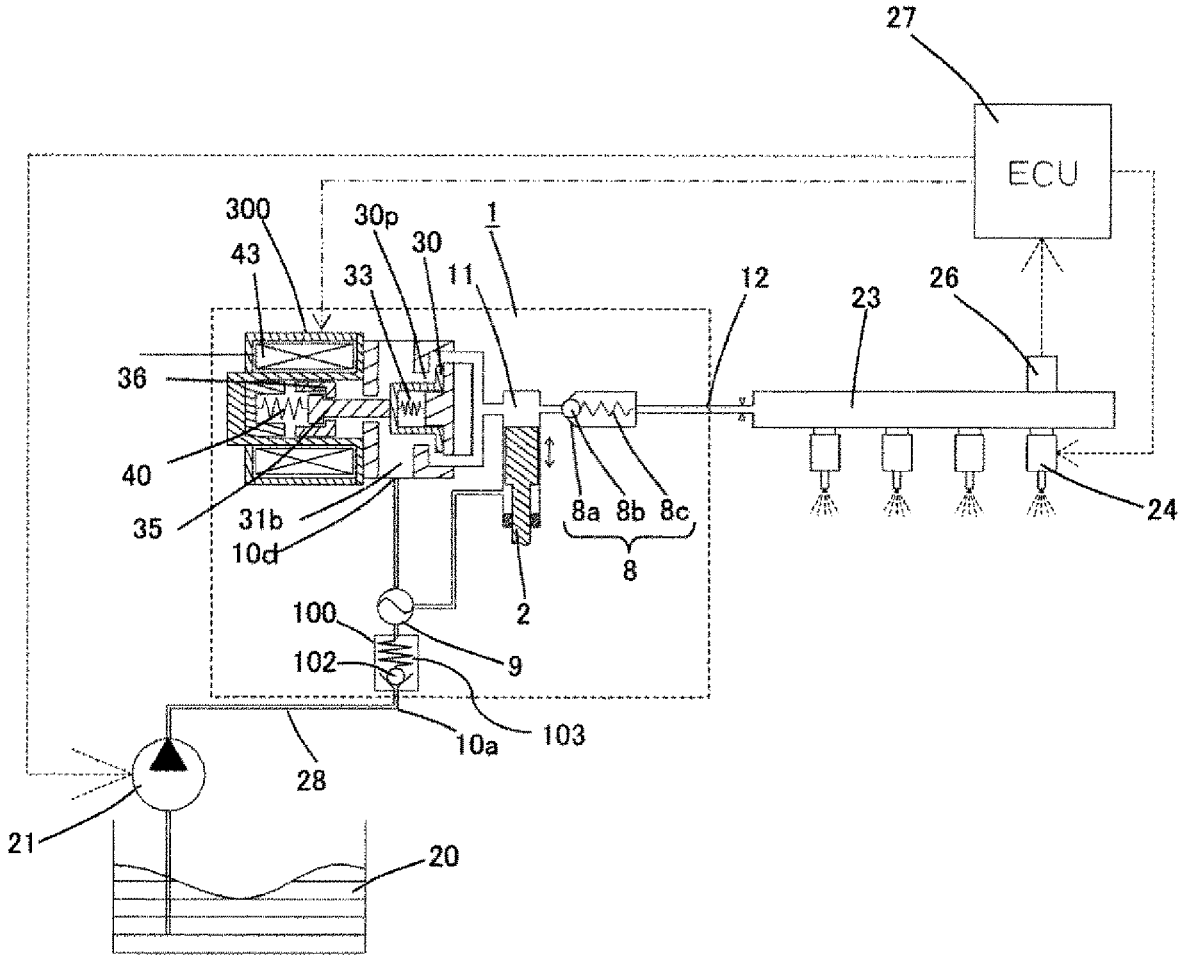
FIG. 5 shows a configuration diagram of an engine system including a high-pressure fuel pump according to the first and second embodiments of the present invention.

A portion surrounded by a broken line shown in FIG. 5 shows a main body of the high-pressure fuel pump. The mechanism/part shown in this broken line is integrally incorporated in a pump body 1.

The fuel in a fuel tank 20 is pumped up by a feed pump 21 based on a signal from an engine control unit 27 (hereinafter referred to as an ECU). This fuel is pressurized to an appropriate feed pressure and sent to a low pressure fuel suction port 10*a* of the high-pressure fuel pump through a suction pipe 28.

Fuel which has passed through a suction joint 51 (see FIG. 2) from the low pressure fuel suction port 10*a* reaches a suction port 31*b* of the electromagnetic suction valve mechanism 300 constituting a capacity variable mechanism via a pressure pulsation reduction mechanism 9 and a suction passage 10*d*.

The fuel flowing into the electromagnetic suction valve mechanism 300 passes through a suction valve 30 and flows into a pressurizing chamber 11. Power to reciprocate a plunger 2 is given by a cam (cam mechanism) 93 (see FIG. 1) of the engine. Due to the reciprocating motion of the plunger 2, in a descending stroke of the plunger 2, fuel is sucked from the suction valve 30, and in a rising stroke, the fuel is pressurized. Fuel is pumped through a discharge valve mechanism 8 to a common rail 23 on which a pressure sensor 26 is mounted. Based on a signal from the ECU 27, an injector 24 injects fuel to the engine. This embodiment is the high-pressure fuel pump applied to a so-called direct injection engine system in which the injector 24 injects fuel directly into the cylinder of the engine.

The high-pressure fuel pump discharges a fuel flow rate of a desired supplied fuel by a signal from the ECU 27 to the electromagnetic suction valve mechanism 300.

In FIG. 5, the high-pressure fuel pump includes a pressure pulsation propagation preventing mechanism 100 in addition to the pressure pulsation reduction mechanism 9, but the pressure pulsation propagation preventing mechanism 100 may be eliminated. In the drawings other than FIG. 5, the pressure pulsation propagation preventing mechanism 100 is not displayed. The pressure pulsation propagation preventing mechanism 100 includes a valve 102 that comes into contact with and separates from a valve seat (not shown), a spring 103 that urges the valve 102 toward the valve seat, and a spring stopper (not shown) that limits a stroke of the valve 102.

First Embodiment

Next, the configuration of the high-pressure fuel pump according to the first embodiment of the present invention will be described in detail with reference to FIGS. 1 to 4.

Figure 1:
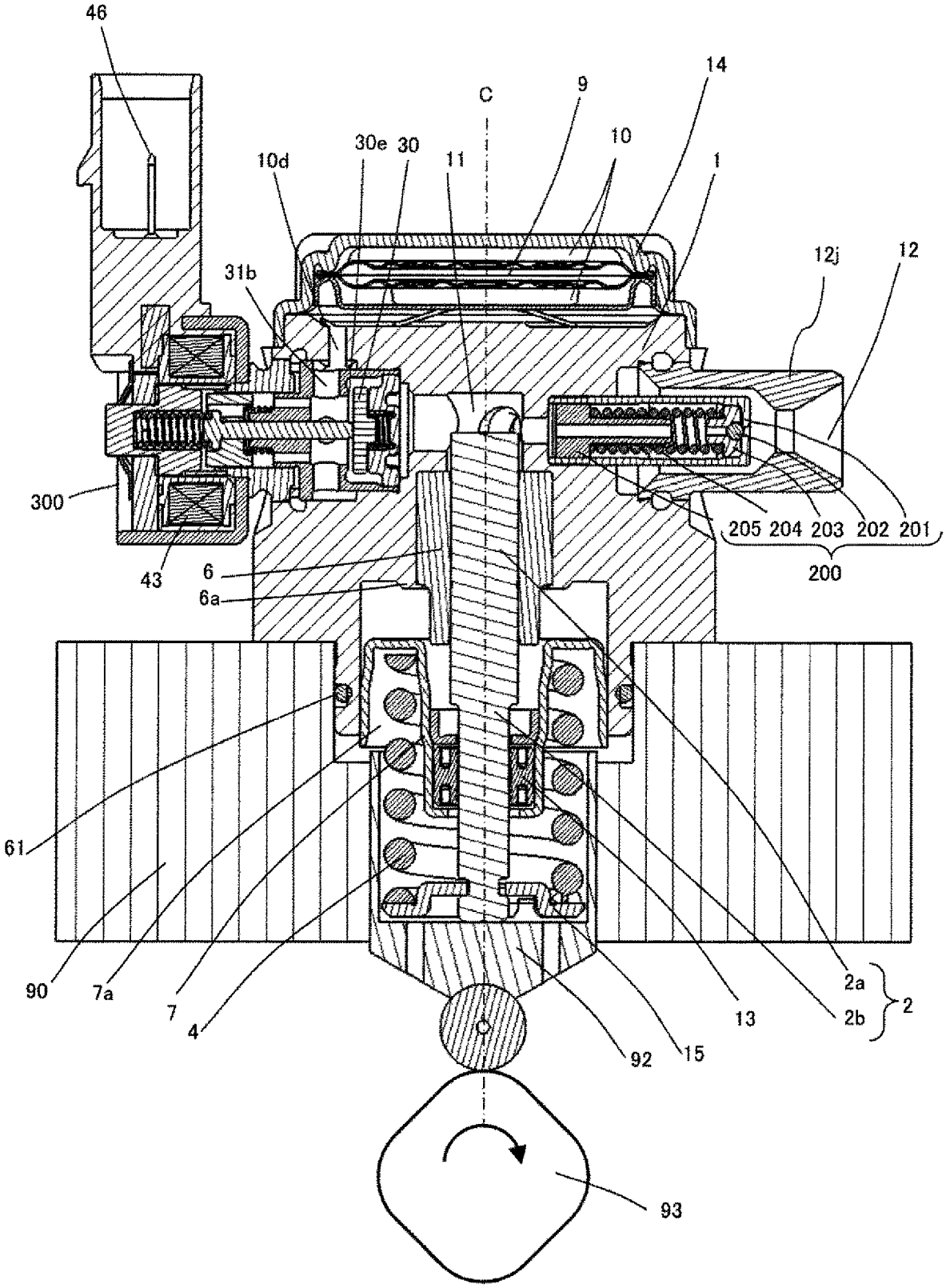
FIG. 1 is a longitudinal sectional view of a high-pressure fuel pump according to a first embodiment of the present invention.
Figure 2:
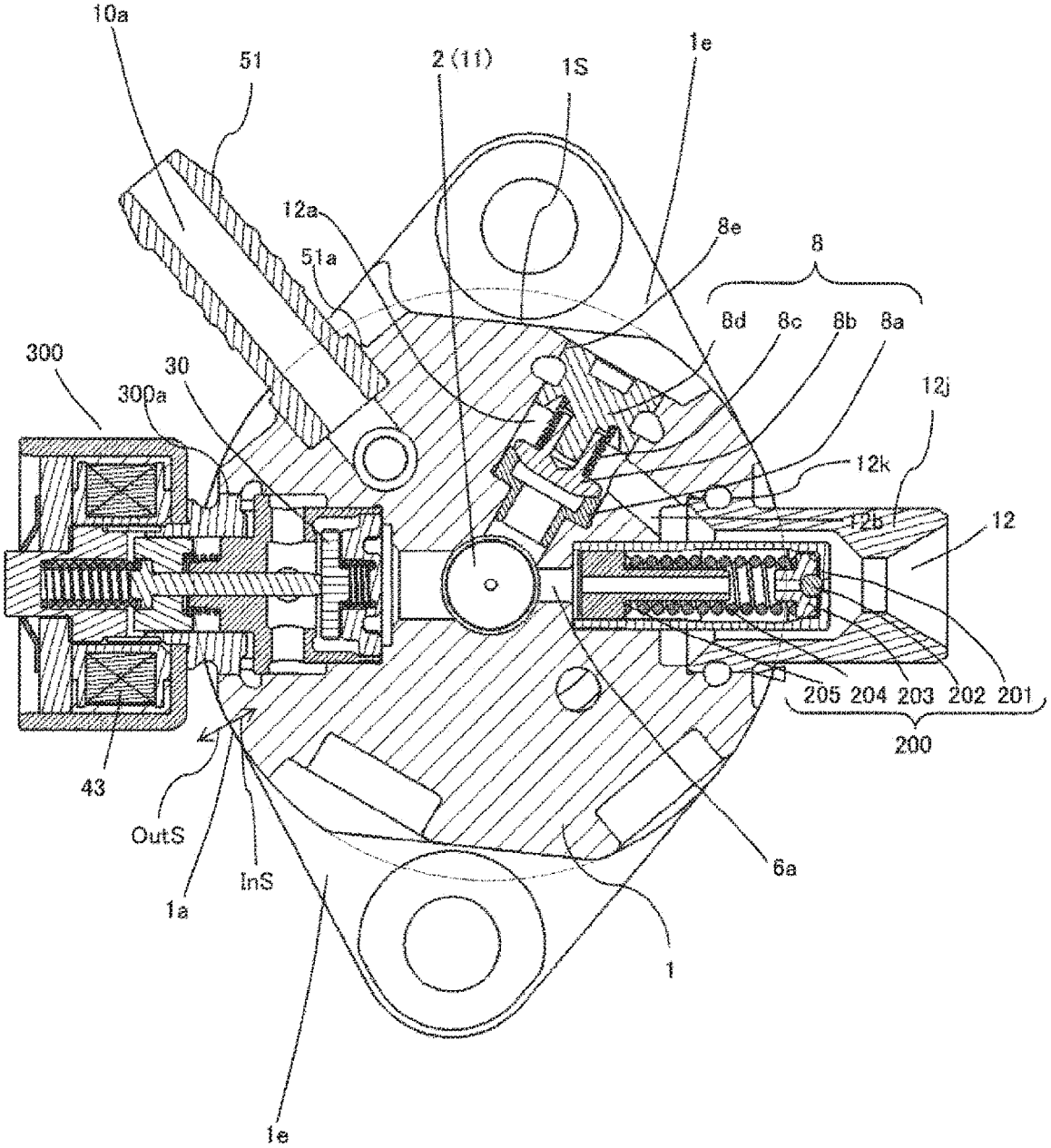
FIG. 2 is a horizontal sectional view of the high-pressure fuel pump according to the first embodiment of the present invention as viewed from above.
Figure 3:
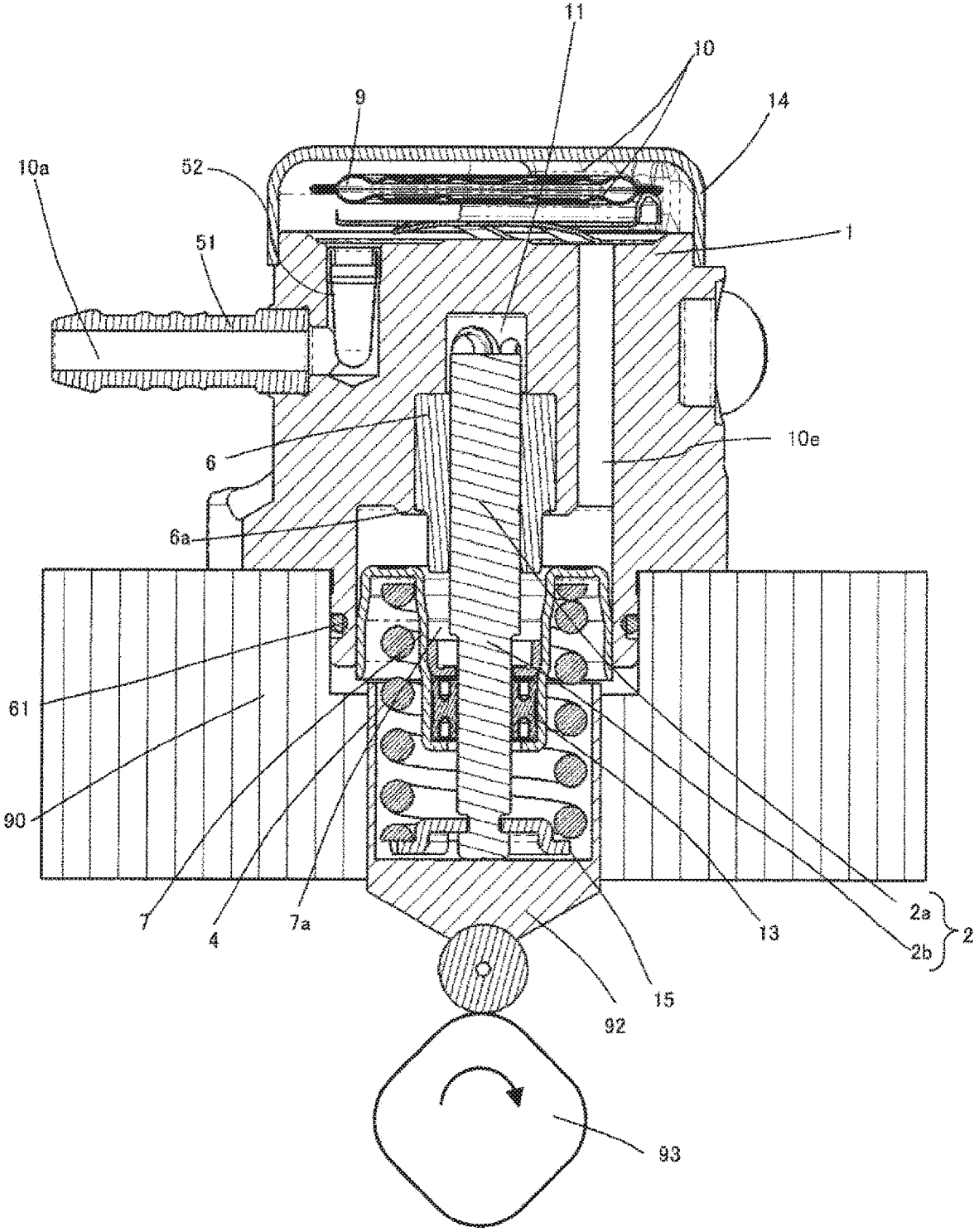
FIG. 3 is a longitudinal sectional view of the high-pressure fuel pump according to the first embodiment of the present invention as viewed from a different direction from FIG. 1.
Figure 4:
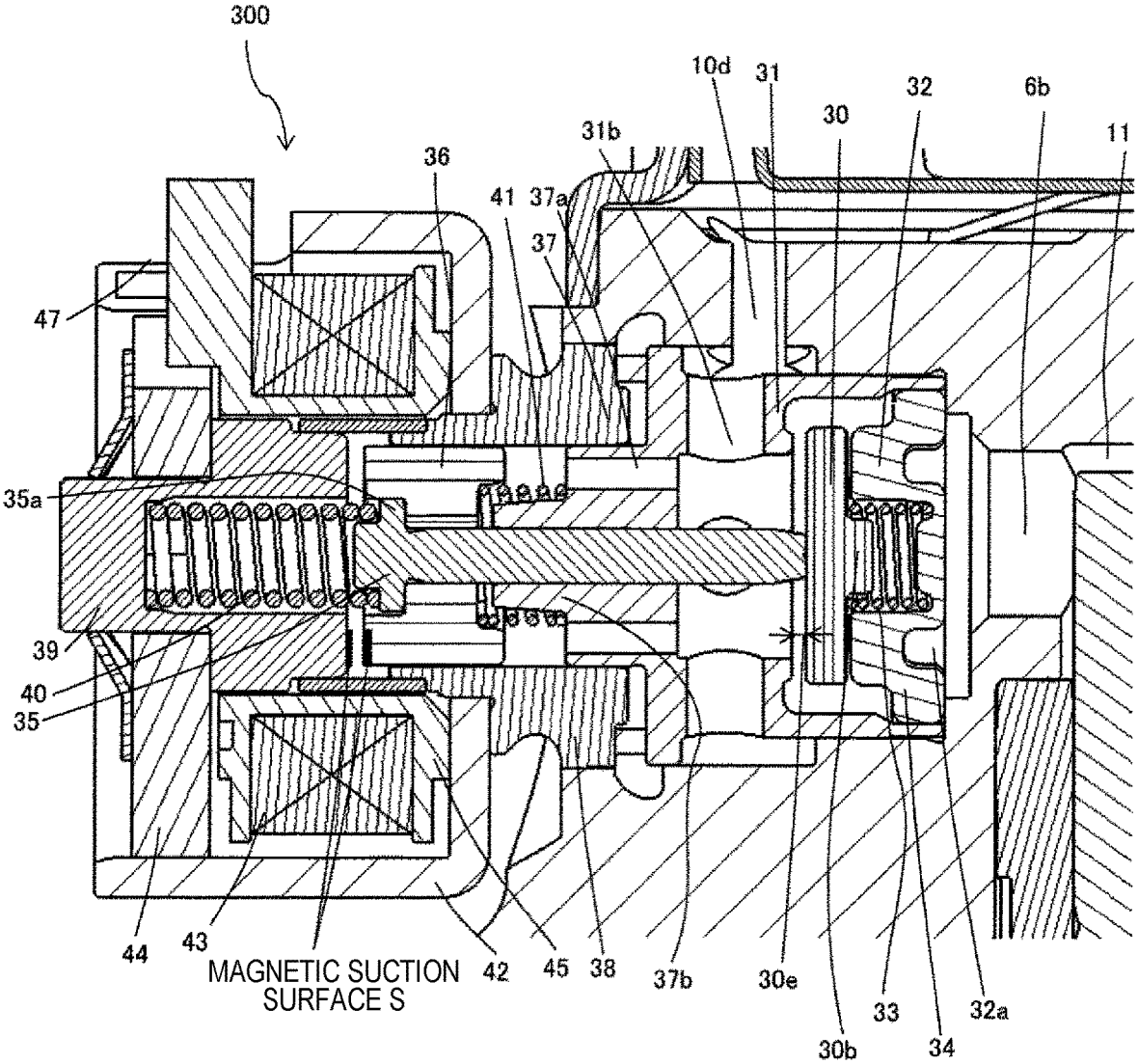
FIG. 4 is an enlarged vertical sectional view of an electromagnetic suction valve mechanism of the high-pressure fuel pump according to the first embodiment of the present invention, and shows that the electromagnetic suction valve mechanism is in an open valve state.

FIG. 1 is a longitudinal sectional view of the high-pressure fuel pump according to the present embodiment, and FIG. 2 is a horizontal sectional view of the high-pressure fuel pump as viewed from above. FIG. 3 is a longitudinal sectional view of the high-pressure fuel pump as viewed from a different direction from FIG. 1. FIG. 4 is an enlarged view of an electromagnetic suction valve mechanism 300 part.

The high-pressure fuel pump of this embodiment comes in close contact with a high-pressure fuel pump attaching portion 90 of an internal combustion engine by using an attaching flange portion 1*e* (see FIG. 2) provided in the pump body 1, and is fixed with a plurality of bolts.

As shown in FIG. 1, an O-ring 61 is fitted into the pump body 1 for sealing between the high-pressure fuel pump attaching portion 90 and the pump body 1 to prevent an engine oil from leaking to the outside.

A cylinder 6 which guides the reciprocating motion of the plunger 2 and forms the pressurizing chamber 11 together with the pump body 1 is attached to the pump body 1. The electromagnetic suction valve mechanism 300 for supplying fuel to the pressurizing chamber 11 and the discharge valve mechanism 8 (see FIG. 2) for discharging fuel from the pressurizing chamber 11 to the discharge passage are provided.

As shown in FIG. 1, the cylinder 6 is press-fitted into the pump body 1 on the outer peripheral side thereof, furthermore, in the fixing portion 6*a*, the body is deformed toward an inner peripheral side, the cylinder is pressed in an upward direction in FIG. 1, and seal is made so that the fuel pressurized in the pressurizing chamber 11 at an upper end face of the cylinder 6 does not leak to a low pressure side.

At a lower end of the plunger 2, a tappet 92 that converts a rotational motion of a cam 93 attached to a camshaft of the internal combustion engine into vertical motion and transmitting the vertical motion to the plunger 2 is provided. The plunger 2 is crimped to the tappet 92 by a spring 4 via a retainer 15. As a result, the plunger 2 can reciprocate up and down along with the rotational motion of the cam 93.

A plunger seal 13 held at a lower end portion of the inner circumference of a seal holder 7 is installed in a slidable contact with the outer periphery of the plunger 2 at the lower portion of the cylinder 6 in FIG. 1. Thereby, when the plunger 2 slides, the fuel in a sub chamber 7*a* is sealed and prevented from flowing into the internal combustion engine. At the same time, the above configuration prevents lubricating oil (including engine oil) lubricating sliding parts in the internal combustion engine from flowing into the pump body 1.

The suction joint 51 (see FIG. 2) is attached to a side surface portion of the pump body 1 of the high-pressure fuel pump. The suction joint 51 is connected to a low pressure pipe that supplies fuel from the fuel tank 20 of the vehicle, and the fuel is supplied to the inside of the high-pressure fuel pump via the low pressure pipe.

A suction filter 52 (see FIG. 3) in the suction joint 51 serves to prevent foreign matter present between the fuel tank 20 and the low pressure fuel suction port 10*a* from being absorbed into the high-pressure fuel pump by the flow of fuel.

As shown in FIG. 1, the fuel having passed through the low pressure fuel suction port 10*a* reaches the suction port 31*b* of the electromagnetic suction valve mechanism 300 via the pressure pulsation reduction mechanism 9 and the suction passage 10*d* (low pressure fuel flow path).

As shown in FIG. 2, the discharge valve mechanism 8 provided at the outlet of the pressurizing chamber 11 includes a discharge valve seat 8*a*, a discharge valve 8*b* which comes into contact with and separates from the discharge valve seat 8*a*, a discharge valve spring 8*c* that urges the discharge valve 8*b* toward the discharge valve seat 8*a*, and a discharge valve stopper 8*d* that determines a stroke (movement distance) of the discharge valve 8*b*. The discharge valve stopper 8*d* and the pump body 1 are joined at a contact portion 8*e* by welding to shut off the fuel from the outside.

In a state where there is no fuel pressure difference between the pressurizing chamber 11 and the discharge valve chamber 12*a*, the discharge valve 8*b* is pressed against the discharge valve seat 8*a* by the urging force of the discharge valve spring 8*c* and is in a closed valve state. The discharge valve 8*b* opens against the discharge valve spring 8*c* only when the fuel pressure in the pressurizing chamber 11 becomes larger than a fuel pressure in the discharge valve chamber 12*a*. The high-pressure fuel in the pressurizing chamber 11 is discharged to the common rail 23 via the discharge valve chamber 12*a*, a fuel discharge passage 12*b*, and a fuel discharge port 12.

When the discharge valve 8*b* opens, the discharge valve 8*b* comes into contact with the discharge valve stopper 8*d*, and the stroke is limited. Therefore, the stroke of the discharge valve 8*b* is appropriately determined by the discharge valve stopper 8*d*. With this configuration, it is possible to prevent that the closing delay of the discharge valve 8*b* due to an excessively large stroke causes the fuel discharged at a high pressure into the discharge valve chamber 12*a* to flow back into the pressurizing chamber 11; therefore, reduction in efficiency of the high-pressure fuel pump can be suppressed. When the discharge valve 8*b* repeats the valve opening and closing movements, the discharge valve 8*b* performs guide on the outer peripheral surface of the discharge valve stopper 8*d* so as to move only in a stroke direction. With the above configuration, the discharge valve mechanism 8 becomes a check valve that restricts a flowing direction of the fuel.

The pressurizing chamber 11 includes the pump body 1 (pump housing), the electromagnetic suction valve mechanism 300, the plunger 2, the cylinder 6, and the discharge valve mechanism 8.

(Operation of High-Pressure Fuel Pump)

When the plunger 2 moves toward the cam 93 by the rotation of the cam 93 (see FIG. 1) and is in the suction stroke state, the volume of the pressurizing chamber 11 increases and the fuel pressure in the pressurizing chamber 11 decreases. In this stroke, when the fuel pressure in the pressurizing chamber 11 becomes lower than the pressure of the suction port 31*b*, the suction valve 30 is in an open state. As shown in FIG. 4, the fuel passes through an opening 30*e* of the suction valve 30 and flows into the pressurizing chamber 11.

After the plunger 2 finishes the suction stroke, the plunger 2 turns into a rising movement and shifts to a compression stroke. Here, an electromagnetic coil 43 is maintained in a non-energized state, and a magnetic biasing force does not act. A rod urging spring 40 is set to have an urging force necessary and sufficient for keeping the suction valve 30 open in a non-energized state. The volume of the pressurizing chamber 11 decreases with the compression movement of the plunger 2; however, in this state, the fuel once drawn into the pressurizing chamber 11 is returned to the suction passage 10*d* again through the opening 30*e* of the suction valve 30 in an open valve state, so that the pressure in the pressurizing chamber never rises. This stroke is referred to as a return stroke.

In this state, when a control signal from the ECU 27 is applied to the electromagnetic suction valve mechanism 300, a current flows through a terminal 46 to the electromagnetic coil 43. Then, the magnetic urging force overcomes the urging force of the rod urging spring 40, and the rod 35 moves in a direction away from the suction valve 30. Therefore, the suction valve 30 is closed by the urging force of the suction valve urging spring 33 and the fluid force caused by the fuel flowing into the suction passage 10*d*. After the valve closes, the fuel pressure in the pressurizing chamber 11 rises together with the rising movement of the plunger 2, and when the pressure exceeds the pressure of the fuel discharge port 12, high-pressure fuel is discharged through the discharge valve mechanism 8 and is supplied to the common rail 23. This stroke is referred to as a discharge strep.

That is, the compression stroke (rising stroke between a lower starting point and an upper starting point) of the plunger 2 includes a return stroke and a discharge stroke. By controlling the energization timing of the electromagnetic coil 43 of the electromagnetic suction valve mechanism 300, it is possible to control the amount of high-pressure fuel to be discharged. If the electromagnetic coil 43 is energized earlier, the rate of the return stroke during the compression stroke is small and the rate of the discharge stroke is large. That is, the amount of fuel returned to the suction passage 10*d* is small, and the amount of fuel discharged at a high pressure is large. On the other hand, if the energization timing is delayed, the rate of the return stroke during the compression stroke is large and the rate of the discharge stroke is small. That is, the amount of fuel returned to the suction passage 10*d* is large, and the amount of fuel discharged at a high pressure is small. The energization timing of the electromagnetic coil 43 is controlled by a command from the ECU 27.

By controlling the conduction timing to the electromagnetic coil 43 as described above, it is possible to control the amount of fuel to be discharged at a high pressure to the amount required by the internal combustion engine.

(Pressure Pulsation Reduction Mechanism)

As shown in FIG. 1, the pressure pulsation reduction mechanism 9 is installed in a low pressure fuel chamber 10 to reduce the pressure pulsation generated in the high-pressure fuel pump from spreading to the suction pipe 28 (fuel pipe). Once the fuel that has flown into the pressurizing chamber 11 is returned to the suction passage 10*d* through the suction valve 30 (suction valve body) that is in the open valve state for capacity control, pressure pulsation occurs in the low pressure fuel chamber 10 due to the fuel returned to the suction passage 10*d*. However, the pressure pulsation reduction mechanism 9 provided in the low pressure fuel chamber 10 is formed by laminating two corrugated metal plates in a corrugated form at the outer periphery thereof, and is formed of a metal diaphragm damper into which an inert gas such as argon is injected. Pressure pulsation is reduced by absorption and contraction of this metal damper.

The plunger 2 has a large-diameter portion 2*a* and a small-diameter portion 2*b*, and the volume of the sub chamber 7*a* is increased or decreased by the reciprocating motion of the plunger. The sub chamber 7*a* communicates with the low pressure fuel chamber 10 through a fuel passage 10*e* (see FIG. 3). When the plunger 2 descends, a flow of fuel is generated from the sub chamber 7*a* to the low pressure fuel chamber 10, and when the plunger 2 rises, a flow of fuel is generated from the low pressure fuel chamber 10 to the sub chamber 7*a*.

As a result, it is possible to reduce the fuel flow rate to the inside and outside of the pump during the suction stroke or return stroke of the pump, and to reduce the pressure pulsation generated inside the high-pressure fuel pump.

(Pump Body)

Next, the configuration around the pump body 1 used in the fuel supply pump of this embodiment will be described in detail.

At the design stage of the high-pressure fuel pump, it is necessary to design the arrangement of each part of the high pressure fuel pump so as to match the engine layout. Specifically, it is necessary to design the arrangement of the suction joint 51, a discharge joint 12*j*, and the electromagnetic suction valve mechanism 300. According to the conventional structure, it has been impossible to change the position of the suction joint 51, the discharge joint 12*j*, and the electromagnetic suction valve mechanism 300 without changing the shape of the pump body 1 and changing the position of the boss portion. Therefore, there is a problem that the layout property of these parts is bad. Further, it is necessary to design and produce the pump body 1 for each engine layout, and there is a problem of increase in producing cost and producing management cost.

In the following, a description will be given of a high-pressure fuel pump with an improved layout flexibility of the suction joint 51, the discharge joint 12*j*, and the electromagnetic suction valve mechanism 300 while suppressing an increase in producing cost.

As shown in FIG. 2, the high-pressure fuel pump of the present embodiment includes the suction joint 51 that sucks fuel, the pump body 1 formed with the pressurizing chamber 11 that pressurizes the fuel sucked from the suction joint 51, the discharge joint 12*j* that discharges the fuel pressurized in the pressurizing chamber 11, and the electromagnetic suction valve mechanism 300. The pump body 1 in which the pressurizing chamber 11 is formed is formed by forging so that at least a part of the side surface portion becomes the cylindrical portion 1*a*.

In this embodiment, as shown in FIG. 2, the discharge joint 12*j*, the suction joint 51, and the electromagnetic suction valve mechanism 300 are all fixed on an inner peripheral side InS with respect to the outermost peripheral portion of the cylindrical portion 1*a* of the side surface portion. Since a fixing part is not exposed to an outer side OutS of the pump body 1, for example, the fixed durability is improved. Further, since all of the discharge joint 12*j*, the suction joint 51, and the electromagnetic suction valve mechanism 300 are fixed to the side surface portion of the pump body 1, the length of the high-pressure fuel pump becomes shorter than the axial direction C (see FIG. 1) of the cylindrical portion 1*a*. Here, as a fixing method, fixation by welding can be most easily performed in producing.

Accordingly, the arrangement of the suction joint 51, the discharge joint 12*j*, and the electromagnetic suction valve mechanism 300 is not limited, and it is possible to perform layout anywhere as necessary. Alternatively, at least a part of the side surface portion is formed in a polygonal shape portion, for example, a hexagonal shape portion; accordingly, the suction joint 51, the discharge joint 12*j*, or the electromagnetic suction valve mechanism 300 can be arranged in one of the hexagons, so that it is possible to improve the layout property as compared with providing the boss portion.

Further, as shown in FIG. 2, the high-pressure fuel pump of the present embodiment includes the flange portion 1*e* in which an attachment hole to the engine is formed, and the flange portion 1*e* is formed integrally with the pump body 1 by forging. As a result, it is possible to omit the number of steps of attaching the flange portion 1*e* to the pump body by welding or the like, so that the production cost can be reduced. The outermost peripheral portion of the flange portion 1*e* is disposed on the outer peripheral side OutS with respect to the outermost peripheral portion of the cylindrical portion 1*a* of the side surface portion.

As shown in FIG. 2, the side surface portion of the pump body 1 is formed so that a portion above the flange portion 1*e* becomes a flat surface portion 1S. Specifically, the side surface portion of the pump body 1 adjacent to the flange portion 1*e* is formed so as to be the flat surface portion 1S perpendicular to the flange portion 1*e*. Accordingly, for example, it is easy to insert a bolt into the attachment hole of the flange portion 1*e* and fasten the bolt with a tool.

In FIG. 2, a relief valve mechanism 200 includes a relief spring 203, a relief body 201 constituting a relief chamber, a valve holder 203 which is urged by a relief spring 204 and holds a relief valve 202 on an outer peripheral side, and a spring stopper 205 that supports the relief spring 204 on a side opposite to the relief valve 202.

(Method for Producing High-Pressure Fuel Pump)

Next, a method for producing the high-pressure fuel pump according to the first embodiment of the present invention will be described with reference to FIG. 9. The method for producing the high-pressure fuel pump includes forging the pump body 1, machining the pump body 1, and fixing the suction joint 51 and the like.

(1) Forging Molding

By forging, at least a part of the side surface portion of the pump body 1 is formed into the cylindrical portion 1*a* (S10). Instead of the cylindrical portion 1*a*, it may be a polygonal shape portion. By forging, the strength of the pump body 1 is improved.

(2) Machining

The inner structure portion of the forged-molded pump body 1 and the like are formed by machining (S20). The internal structure portion includes a press-fitting fitting portion with the pressurizing chamber 11 and the cylinder 6, a fitting portion with the suction joint 51, the discharge joint 12*j*, the electromagnetic suction valve mechanism 300, and the like.

(3) Fixation

In this embodiment, the discharge joint 12*j*, the suction joint 51, and the electromagnetic suction valve mechanism 300 are all fixed on an inner peripheral side with respect to the outermost peripheral portion of the cylindrical portion 1*a* of the side surface portion (S30).

Figure 9:
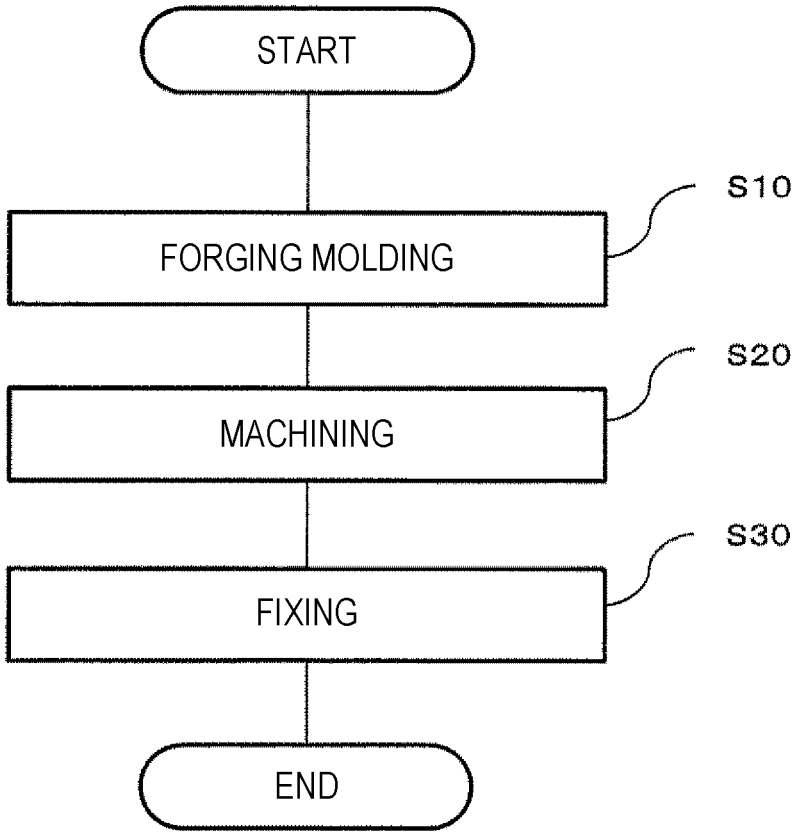
FIG. 9 is a flowchart showing a method of producing the high-pressure fuel pump according to the first embodiment of the present invention.

As described above, the method for producing the high-pressure fuel pump according to the present embodiment includes, as shown in FIG. 9, a first step (S10) of forming by forging so that at least a part of the side surface portion of the pump body 1 where the pressurizing chamber 11 is formed becomes the cylindrical portion 1*a*, and a second step (S30) of fixing all of the discharge joint 12*j*, the suction joint 51, and the electromagnetic suction valve mechanism 300 to the pump body 1 on the inner peripheral side with respect to the outermost peripheral portion of the cylindrical portion 1*a* of the side surface portion. Since there is no boss producing step, for example, the producing cost can be suppressed.

In this producing method, it is preferable to use a producing method in which any or all of these functional parts (51, 12*j*, and 300) are fixed to the pump body 1 by welding.

As described above, according to the present invention, it is possible to improve the degree of freedom in the layout of a member to be attached to a pump body. That is, it is possible to improve the degree of freedom of layout of the suction joint, the discharge joint, the electromagnetic suction valve mechanism and the like while suppressing an increase in producing cost. Therefore, it is possible to suppress the number of models of the pump body and the management cost.

Here, as shown in FIG. 2, after the discharge valve seat 8*a*, the discharge valve 8*b*, and the discharge valve spring 8*c* are inserted into the discharge valve hole formed in the pump body 1, the discharge valve mechanism 8 of the present embodiment inserts the discharge valve stopper 8*d* into the discharge valve hole to close the hole. Here, a part of the cylindrical portion 1*a* of the pump body 1 is scraped to the inner peripheral side, and at this scraped portion, the discharge valve stopper 8*d* is welded to the pump body 1 from the outer peripheral side. More specifically, a welding beam is applied to the discharge valve stopper 8*d* from the outside in the axial direction of the discharge valve spring 8*c* toward the inner peripheral direction, and a contact portion 8*e* is welded and fixed. This makes it possible to dispose the discharge valve mechanism 8 on the inner peripheral side with respect to the outermost peripheral portion of the cylindrical portion 1*a* of the side surface portion of the pump body 1. In the present embodiment, the discharge valve stopper 8*d* also plays a role of closing the discharge valve hole, but this is not a limitation, and a separate seal member may be used instead of the discharge valve stopper 8*d*.

Second Embodiment

Next, a second embodiment will be described.

Figure 6:
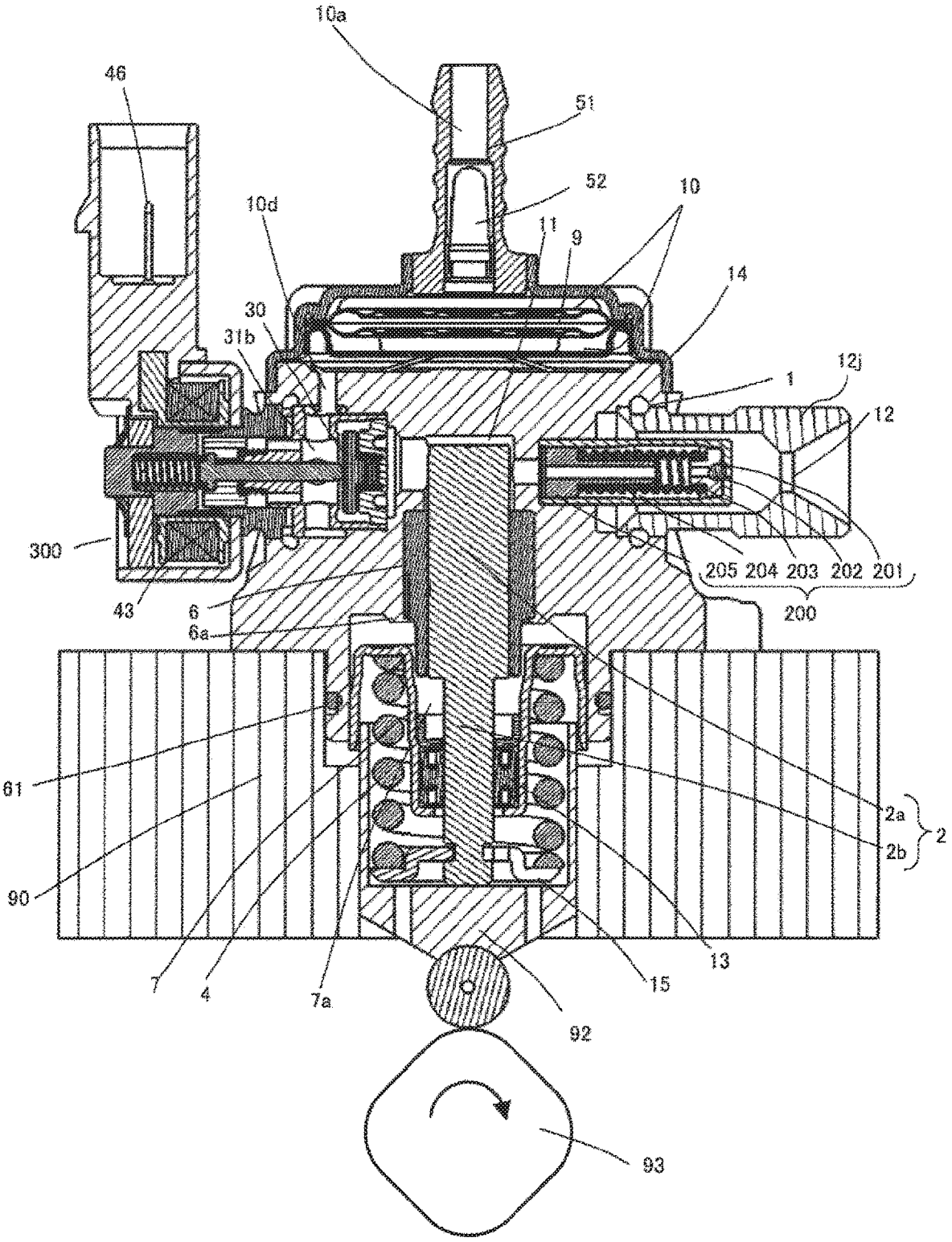
FIG. 6 is a longitudinal sectional view of the high-pressure fuel pump according to the second embodiment of the present invention.
Figure 7:
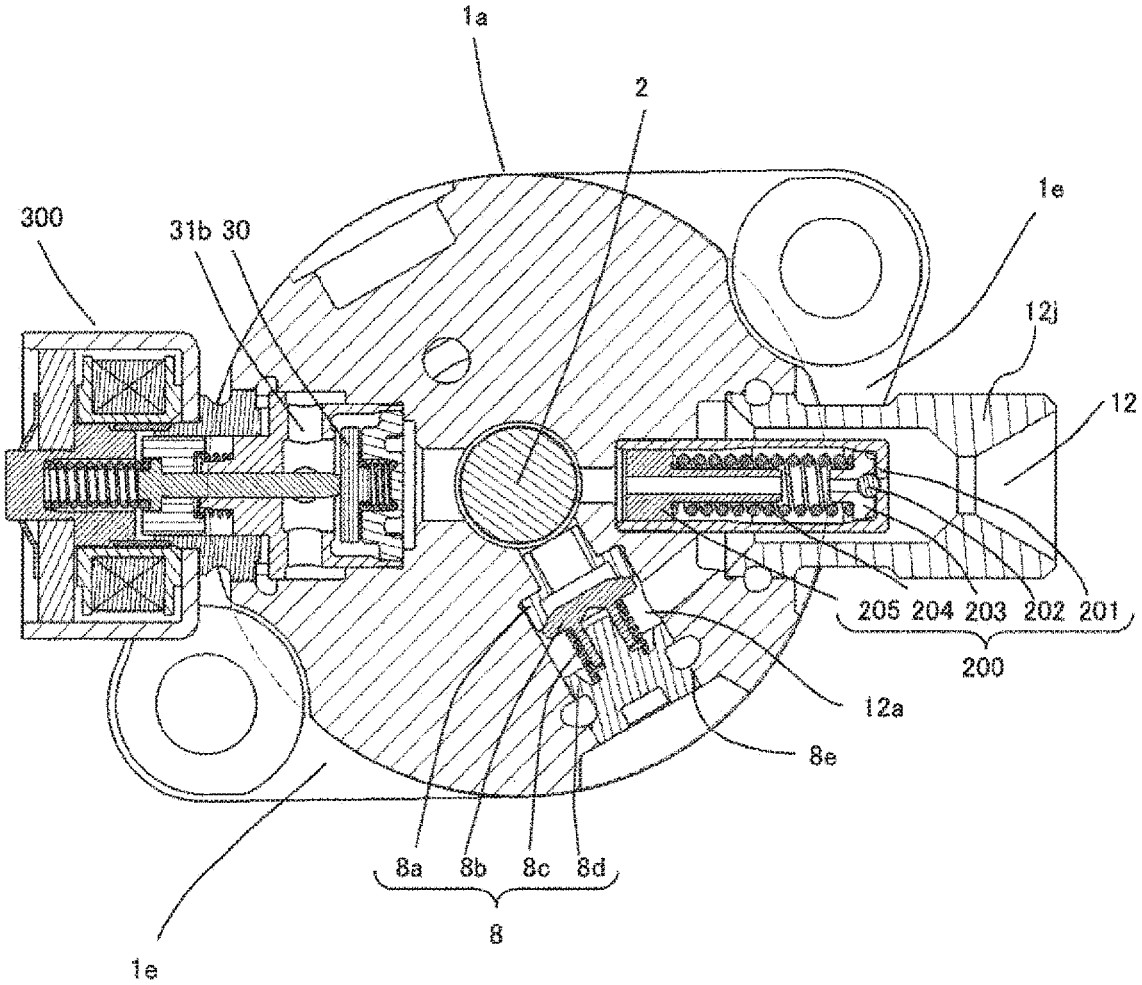
FIG. 7 is a horizontal sectional view of the high-pressure fuel pump according to the second embodiment of the present invention as viewed from above.
Figure 8:
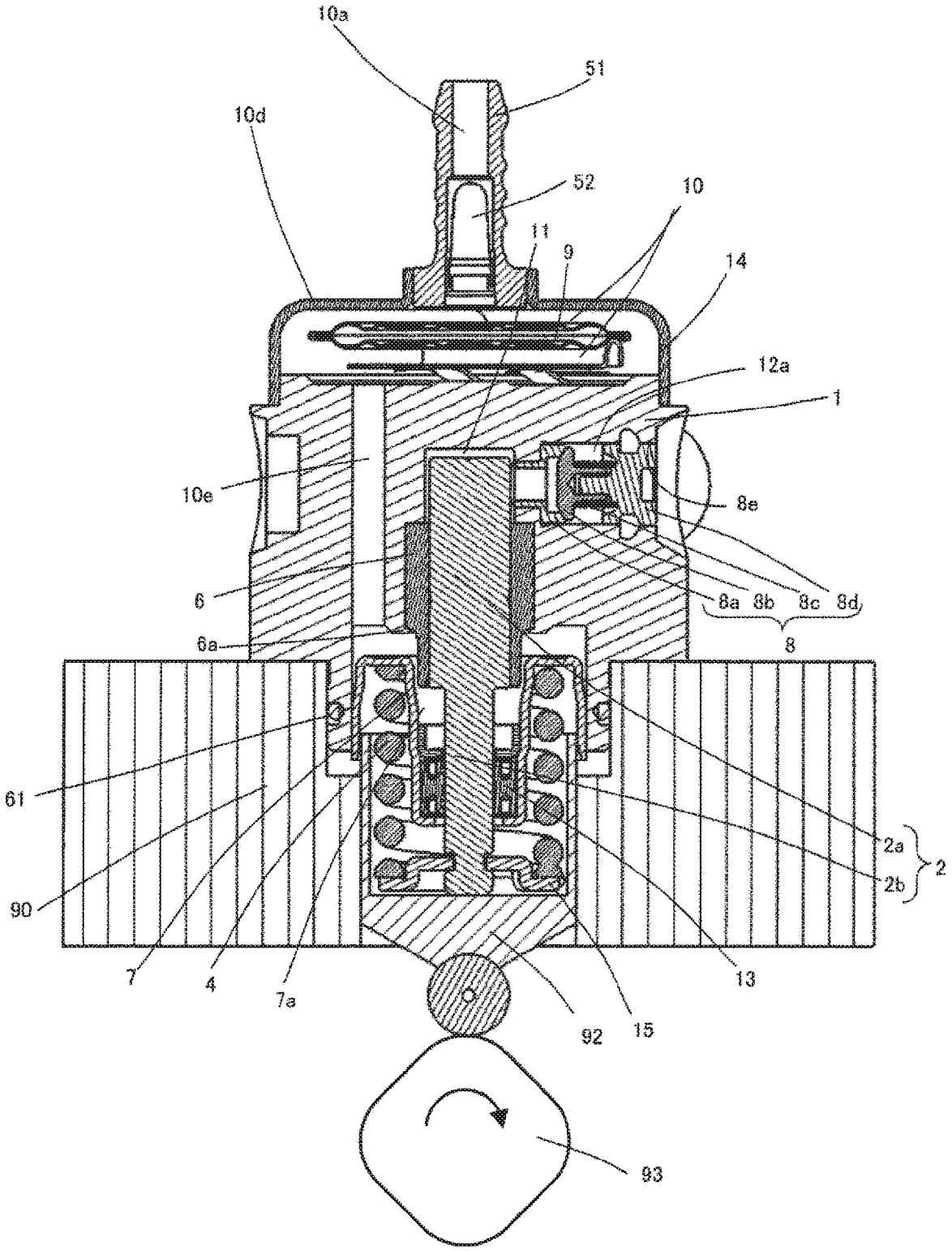
FIG. 8 is a longitudinal sectional view of the high-pressure fuel pump according to the second embodiment of the present invention as viewed from a different direction from FIG. 6.

FIG. 6 is a longitudinal sectional view of the high-pressure fuel pump according to the present embodiment, and FIG. 7 is a horizontal sectional view of the high-pressure fuel pump as viewed from above. FIG. 8 is a longitudinal sectional view of the high-pressure fuel pump as viewed from a different direction from FIG. 6. In the high-pressure fuel pump of the first embodiment, the suction joint 51 is fixed to the pump body 1, but in the second embodiment, the suction joint 51 is provided in a damper cover 14.

The other points are the same as those of the first embodiment, and the effect of improving the layout property of the pump body 1 is the same according to the present embodiment.

It should be noted that the present invention is not limited to the above-described embodiment, but includes various modified examples. For example, the above-described embodiments have been described in detail for easy understanding of the present invention, and are not necessarily limited to those having all the configurations described. In addition, a part of the configuration of one embodiment can be replaced by the configuration of another embodiment, and the configuration of another embodiment can be added to the configuration of one embodiment. Further, it is possible to add, delete, and replace other configurations with respect to part of the configuration of each embodiment.

In the above-described embodiment, the pump body 1 is formed so that at least a part of the side surface portion thereof becomes the cylindrical portion 1*a*, but may be a polygonal shape portion instead of the cylindrical portion 1*a*.

Fixing of the discharge joint 12*j*, the suction joint 51, and the electromagnetic suction valve mechanism 300 to the pump body 1 is not limited to the above embodiment.

For example, at least one of the discharge joint 12*j* and the suction joint 51 may be fixed on the inner peripheral side with respect to the outermost peripheral portion of the cylindrical portion 1*a* or the polygonal shape portion of the side surface portion.

Further, at least one of the discharge joint 12*j*, the suction joint 51, and the electromagnetic suction valve mechanism 300 may be fixed on the inner peripheral side with respect to the outermost peripheral portion of the cylindrical portion or the polygonal shape portion of the side surface portion.

Furthermore, the suction joint 51 and the discharge joint 12*j* may be fixed to the pump body 1 on the inner peripheral side with respect to the outermost peripheral portion of the cylindrical portion or the polygonal shape portion of the side surface portion. The same is true for the method of producing the high-pressure fuel pump.

Here, as shown in FIG. 2, in a discharge joint hole, a part of the cylindrical portion 1*a* of the pump body 1 is scraped to the inner peripheral side, and at this scraped portion, the discharge joint 12*j* is welded to the pump body 1 from the outer peripheral side. More specifically, a welding beam is applied to the discharge joint 12*j* from the outside in the axial direction of the discharge joint 12*j* toward the inner peripheral direction, and a contact portion 12*k* is welded and fixed. This makes it possible to dispose the discharge joint 12*j* on the inner peripheral side with respect to the outermost peripheral portion of the cylindrical portion 1*a* of the side surface portion of the pump body 1. In this embodiment, the discharge joint 12*j* covers the relief valve mechanism 200, but the present invention is not limited thereto, and the discharge joint mechanism may cover the discharge valve mechanism.

The same is true for the suction joint 51, and in a suction joint hole, a part of the cylindrical portion 1*a* of the pump body 1 is scraped to the inner peripheral side, and at this scraped portion, the suction joint 51 is welded to the pump body 1 from the outer peripheral side. More specifically, a welding beam is applied to the suction joint 51 from the outside in the axial direction of the suction joint 51 toward the inner peripheral direction, and a contact portion 51*a* is welded and fixed. This makes it possible to dispose the suction joint 51 on the inner peripheral side with respect to the outermost peripheral portion of the cylindrical portion 1*a* of the side surface portion of the pump body 1.

The same is true for the electromagnetic suction valve mechanism 300, and in a suction valve hole, a part of the cylindrical portion 1*a* of the pump body 1 is scraped to the inner peripheral side, and at this scraped portion, the electromagnetic suction valve mechanism 300 is welded to the pump body 1 from the outer peripheral side. More specifically, a welding beam is applied to the electromagnetic suction valve mechanism 300 from the outside in the axial direction of the electromagnetic suction valve mechanism 300 toward the inner peripheral direction, and a contact portion 300*a* is welded and fixed. This makes it possible to dispose the electromagnetic suction valve mechanism 300 on the inner peripheral side with respect to the outermost peripheral portion of the cylindrical portion 1*a* of the side surface portion of the pump body 1.

As described above, at least one of the discharge joint 12*j*, the suction joint 51, and the electromagnetic suction valve mechanism 300 is welded by applying a welding beam from the respective outer peripheral sides in the axial direction. Accordingly, it is possible to perform welding fixation even if they are arranged close to each other, thereby improving layout performance.

REFERENCE SIGNS LIST

1 pump body
2 plunger
6 cylinder
7 seal holder
8 discharge valve mechanism
9 pressure pulsation reduction mechanism
10*a* low pressure fuel suction port
11 pressurizing chamber
12 fuel discharge port
12*j* discharge joint
13 plunger seal
30 suction valve

40 rod urging spring
43 electromagnetic coil
100 pressure pulsation propagation preventing mechanism
101 valve seat
102 valve
103 spring
104 spring stopper
200 relief valve mechanism
201 relief body
202 relief valve
203 valve holder
204 relief spring
205 spring stopper
300 electromagnetic suction valve mechanism

The invention claimed is:

1. A high-pressure fuel pump comprising:
a suction joint that sucks fuel;
a pump body formed with a pressurizing chamber that pressurizes the fuel sucked from the suction joint; and
a discharge joint that is disposed in a discharge joint hole, the discharge joint discharging the fuel pressurized in the pressurizing chamber, wherein
the pump body is formed such that at least a part of a side surface portion is a cylindrical portion,
the discharge joint hole being formed in a first scraped region of the side surface portion of the pump body, the first scraped region being located radially inward of an outermost peripheral surface of the cylindrical portion in a horizontal sectional view of the pump body as viewed from above,
a second scraped region of the side surface portion of the pump body being located opposite to the first scraped region and perpendicular to an axial direction of the discharge joint in a horizontal sectional view of the pump body as viewed from above, and
the discharge joint is fitted in the discharge joint hole and welded to the pump body at a welded portion which is formed on an outer surface of the first scraped region of the pump body.

2. The high-pressure fuel pump according to claim 1, further comprising a flange portion in which an attachment hole to an engine is formed,
wherein the flange portion is formed integrally with the pump body.

3. The high-pressure fuel pump according to claim 1, further comprising a suction valve hole being formed in the second scraped region of the side surface portion of the pump body, the second scraped region being located radially inward of an outermost peripheral surface of the cylindrical portion in a horizontal sectional view of the pump body as viewed from above,
the first scraped region of the side surface portion of the pump body being located opposite to the second scraped region and perpendicular to an axial direction of an electromagnetic suction valve mechanism in a horizontal sectional view of the pump body as viewed from above, and
the electromagnetic suction valve mechanism is fitted in the suction valve hole and welded to the pump body at a welded portion, which is formed on an outer surface of the second scraped region of the pump body.

4. The high-pressure fuel pump according to claim 2,
wherein the side surface portion of the pump body adjacent to the flange portion is formed to be a flat surface portion perpendicular to the flange portion.

5. The high-pressure fuel pump according to claim 1,
wherein the welded portion is located on an inner peripheral side with respect to the outermost peripheral surface of the cylindrical portion.

6. A high-pressure fuel pump comprising:
a suction joint that sucks fuel;
a pump body formed with a pressurizing chamber that pressurizes the fuel sucked from the suction joint;
a discharge joint that discharges the fuel pressurized in the pressurizing chamber; and
an electromagnetic suction valve mechanism that is disposed in a suction valve hole, wherein
the pump body is formed such that at least a part of a side surface portion is a cylindrical portion, and the pump body includes a scraped part,
a first scraped region of the side surface portion of the pump body being located opposite to a second scraped region and perpendicular to an axial direction of the electromagnetic suction valve mechanism in a horizontal sectional view of the pump body as viewed from above,
the suction valve hole being formed in the second scraped region of the side surface portion of the pump body, the second scraped region being located radially inward of an outermost peripheral surface of the cylindrical portion in a horizontal sectional view of the pump body as viewed from above, and
the electromagnetic suction valve mechanism is fitted in the suction valve hole and welded to the pump body at a welded portion, which is formed on an outer surface of the second scraped region of the pump body.

7. The high-pressure fuel pump according to claim 6, further comprising a flange portion in which an attachment hole to an engine is formed, wherein the flange portion is formed integrally with the pump body.

8. The high-pressure fuel pump according to claim 6, further comprising a flange portion in which an attachment hole to an engine is formed,
wherein an outermost peripheral portion of the flange portion is disposed on an outer peripheral side with respect to the outermost peripheral portion of the cylindrical portion.

9. The high-pressure fuel pump according to claim 6,
wherein the suction joint and the discharge joint are welded to the pump body on the inner peripheral side with respect to the outermost peripheral portion of the cylindrical portion.

10. A method of producing a high-pressure fuel pump comprising:
forming a suction joint that sucks fuel;
forming a pump body having a pressurizing chamber that pressurizes the fuel sucked from the suction joint; and
forming a discharge joint that is disposed in a discharge joint hole, the discharge joint discharging the fuel pressurized in the pressurizing chamber, wherein
the pump body is formed such that at least a part of a side surface portion is a cylindrical portion,
the discharge joint hole being formed in a first scraped region of the side surface portion of the pump body, the first scraped region being located radially sectional view of the pump body as viewed from above,
a second scraped region of the side surface portion of the pump body being located opposite to the first scraped region and perpendicular to an axial direction of the discharge joint in a horizontal sectional view of the pump body as viewed from above, and the discharge joint is fitted in the discharge joint hole and welded to the pump body at a welded portion which is formed on an outer surface of the first scraped region of the pump body.

* * * * *